US007337109B2

(12) United States Patent
Wu

(10) Patent No.: US 7,337,109 B2
(45) Date of Patent: Feb. 26, 2008

(54) MULTIPLE STEP ADAPTIVE METHOD FOR TIME SCALING

(75) Inventor: Gin-Der Wu, Taipei (TW)

(73) Assignee: ALI Corporation, Taipei (TW)

( * ) Notice: Subject to any disclaimer, the term of this patent is extended or adjusted under 35 U.S.C. 154(b) by 930 days.

(21) Appl. No.: 10/605,482

(22) Filed: Oct. 2, 2003

(65) Prior Publication Data

US 2005/0027518 A1 Feb. 3, 2005

(30) Foreign Application Priority Data

Jul. 21, 2003 (TW) ..... 92119876 A

(51) Int. Cl.
*G10L 21/04* (2006.01)
*G10L 19/00* (2006.01)
*G10L 13/00* (2006.01)

(52) U.S. Cl. ..... 704/218; 704/258; 704/220; 704/237; 375/343

(58) Field of Classification Search ..... 704/218, 704/220, 237, 258, 243; 375/243, 343
See application file for complete search history.

(56) References Cited

U.S. PATENT DOCUMENTS 5,175,769 A * 12/1992 Hejna et al. ..... 704/211
5,845,247 A * 12/1998 Miyasaka ..... 704/267
6,049,766 A * 4/2000 Laroche ..... 704/216
6,484,137 B1 * 11/2002 Taniguchi et al. ..... 704/211
6,801,898 B1 * 10/2004 Koezuka ..... 704/500
6,944,510 B1 * 9/2005 Ballesty et al. ..... 700/94
2005/0273321 A1 * 12/2005 Choi ..... 704/207

* cited by examiner

*Primary Examiner*—David Hudspeth
*Assistant Examiner*—Abdelali Serrou
(74) *Attorney, Agent, or Firm*—Winston Hsu

(57) ABSTRACT

A multiple step adaptive method for time scaling. Synthesizing $S_3[n]$ signal from signal $S_1[n]$signal and $S_2[n]$signal. Comprising following steps: (a) calculating a first magnitude of a cross-correlation function of $S_1[n]$signal and $S_2[n]$signal according to a first index; (b) comparing the first magnitude with a threshold value; (c) if first magnitude is smaller than threshold value, calculating a first reference magnitude of cross-correlation function of $S_1[n]$signal and $S_2[n]$signal according to a first reference index behind the first index by a first determined number, or calculating a second reference magnitude of the cross-correlation function of the $S_1[n]$ signal and the $S_2[n]$ signal according to a second reference index behind the first index by a second number; (d) synthesizing the $S_3[n]$ signal by adding $S_1[n]$signal to the $S_2[n]$ signal in accordance with a maximum index corresponding to a largest magnitude among all the magnitudes calculated in (c).

16 Claims, 6 Drawing Sheets

MULTIPLE STEP ADAPTIVE METHOD FOR TIME SCALING

BACKGROUND OF INVENTION

1. Field of the Invention

The present invention relates to a signal-synthesizing method, and more particularly, to a multiple step adaptive method for time-scaling.

2. Description of the Prior Art

Due to the dramatic progress in electronic technologies, an AV player such as a Karaoke can provide more and more amazing functions, such as audio clean-up, dynamic repositioning of enhanced audio and music (DREAM), and time scaling. Time scaling (also called time stretching, time compression/expansion, or time correction) is a function to elongate or shorten an audio signal while keeping the pitch of the audio signal approximately unchanged. In short, time scaling only adjusts the tempo of an audio signal.

In general, an AV player performs time scaling with one of three following methods: Phase Vocoder, Minimum Perceived Loss Time Expansion/Compression (MPEX), and Time Domain Harmonic Scaling (TDHS). Phase Vocoder transforms an audio signal into a complex Fourier representation signal with Short Time Fourier Transform (STFT) and further transforms the complex Fourier representation signal back to a time scaled audio signal corresponding to the original audio signal with interpolation techniques and iSTFT (inverse STFT). MPEX is a method researched and developed by Prosoniq for simulating characteristics of human hearing, similar to artificial neural network. MPEX records audio signals received for a predetermined period and tries to "learn" the audio signals, so as to either elongate or shorten the audio signals. TDHS is one of the most popular methods for time scaling. TDHS first establishes an autocorrelogram of a first audio signal, the autocorrelogram consisting of a plurality of magnitudes, and then delays the first audio signal by a maximum index corresponding to a maximum magnitude, a largest magnitude among all of the magnitudes of the autocorrelogram, to form a second audio signal, and lastly synchronizes and overlap-adds (SOLA) the first audio signal to the second audio signal to form a third audio signal longer than the first audio signal.

Please refer to FIG. 1, which is an autocorrelogram 10 for TDHS according to the prior art, the autocorrelogram 10 consisting of a plurality of magnitudes. In general, besides a maximum magnitude 12 and magnitudes there away, remaining magnitudes in the autocorrelogram 10 has a small value. In addition, two neighboring magnitudes of the autocorrelogram 10 differ slightly. For example, if a first magnitude 14 is far smaller than the maximum magnitude 12, a second magnitude 16 neighboring the first magnitude 14 is also far smaller than the maximum magnitude 12. On the contrary, if a third magnitude 18 differs slightly from the maximum magnitude 12, a fourth magnitude 20 neighboring the third magnitude 18 is probably very close to the maximum magnitude 12 and accordingly a fourth index $$\tau_4$$

(corresponding to the third 18 or fourth magnitude 20 as shown in FIG. 1) is also probably very close to a maximum index $$\tau_{max}$$

corresponding to the maximum magnitude 12.

In a computer system, the autocorrelogram 10 is usually established by a digital signal processing (DSP) chip designed to manage complex mathematic calculation such as convolution and fast Fourier transform (FFT). However, a process to determine the maximum magnitude 12 and the corresponding maximum index $$\tau_{max}$$

by establishing the autocorrelogram 10 with a DSP chip is tedious and sometimes unnecessary.

SUMMARY OF INVENTION

It is therefore a primary objective of the claimed invention to provide a multiple level adaptive method for time scaling capable of determining a maximum index corresponding to $S_1[n]$ and $S_2[n]$ signals efficiently and synthesizing an $S_3[n]$ signalfrom the $S_1[n]$ and $S_2[n]$ signals.

According to the claimed invention, the method comprises following steps: (a) calculating a first magnitude of a cross-correlation function of the $S_1[n]$ signal and the $S_2[n]$ signal according to a first index; (b) comparing the first magnitude with a threshold value; (c) if the first magnitude is smaller than the threshold value, calculating a first reference magnitude of the cross-correlation function of the $S_1[n]$ signal and the $S_2[n]$ signal according to a first reference index behind the first index by a first determined number, or calculating a second reference magnitude of the cross-correlation function of the $S_1[n]$ signal and the $S_2[n]$ signal according to a second reference index behind the first index by a second number; and (d) synthesizing the $S_3[n]$ signal by adding the $S_1[n]$ signal to the $S_2[n]$ signal in accordance with a maximum index corresponding to the largest magnitude among all of the magnitudes calculated in step (c).

In the preferred embodiment of the present invention, the first predetermined number is larger than one, while the second predetermined number is equal to one.

It is an advantage of the claimed invention that a DSP chip does not have to calculate all of the magnitudes in an autocorrelogram, thus saving time to establish the autocorrelogram and promoting the efficiency of a computer where the DSP chip is installed in.

These and other objectives of the claimed invention will no doubt become obvious to those of ordinary skill in the art after reading the following detailed description of the preferred embodiment that is illustrated in the various figures and drawings.

DETAILED DESCRIPTION

In a process of establishing an autocorrelogram of a first audio signal and a second audio signal, a method 100 of the preferred embodiment of the present invention compares a magnitude corresponding to an index in the autocorrelogram with either a first threshold $th_1$ or a second threshold $th_2$, the first threshold $th_1$ smaller than the second threshold $th_2$, and calculates magnitudes corresponding to indexes following the index in the autocorrelogram. In detail, if a first magnitude $$R(\tau_1)$$

in the autocorrelogram is smaller than the first threshold $th_1$, indicating a first index corresponding to the first magnitude $$R(\tau_1)$$

is still far from a maximum magnitude $$R(\tau_{max})$$

corresponding to a maximum index $$\tau_{max}$$

, the method 100 calculates a second magnitude $$R(\tau_2)$$

corresponding to a second index $$\tau_2$$

lagging the first index $$\tau_1$$

by a first predetermined number $\Delta_1$; If a third magnitude $$R(\tau_3)$$

in the autocorrelogram is larger than the first threshold $th_1$ but still smaller than the second threshold $th_2$, indicating a third index $$\tau_3$$

corresponding to the third magnitude $$R(\tau_3)$$

is closer to the maximum index $$\tau_{max}$$

than the first index $$\tau_1$$

, the method 100 calculates a fourth magnitude $$R(\tau_4)$$

corresponding to a fourth index $$\tau_4$$

lagging the third index $$\tau_3$$

by a second predetermined number$\Delta_2$, the second predetermined number$\Delta_2$ smaller than the first predetermined number$\Delta_1$; If a fifth magnitude $$R(\tau_5)$$

in the autocorrelogram is larger than the second threshold $th_2$, indicating a fifth index $$\tau_5$$

corresponding to the fifth magnitude $$R(\tau_5)$$

is quite close to the maximum index $$\tau_{max}$$

, the method 100 calculates a sixth magnitude $$R(\tau_6)$$

corresponding to a sixth index $$\tau_6$$

right after the fifth index $$\tau_5$$

Figure 1:
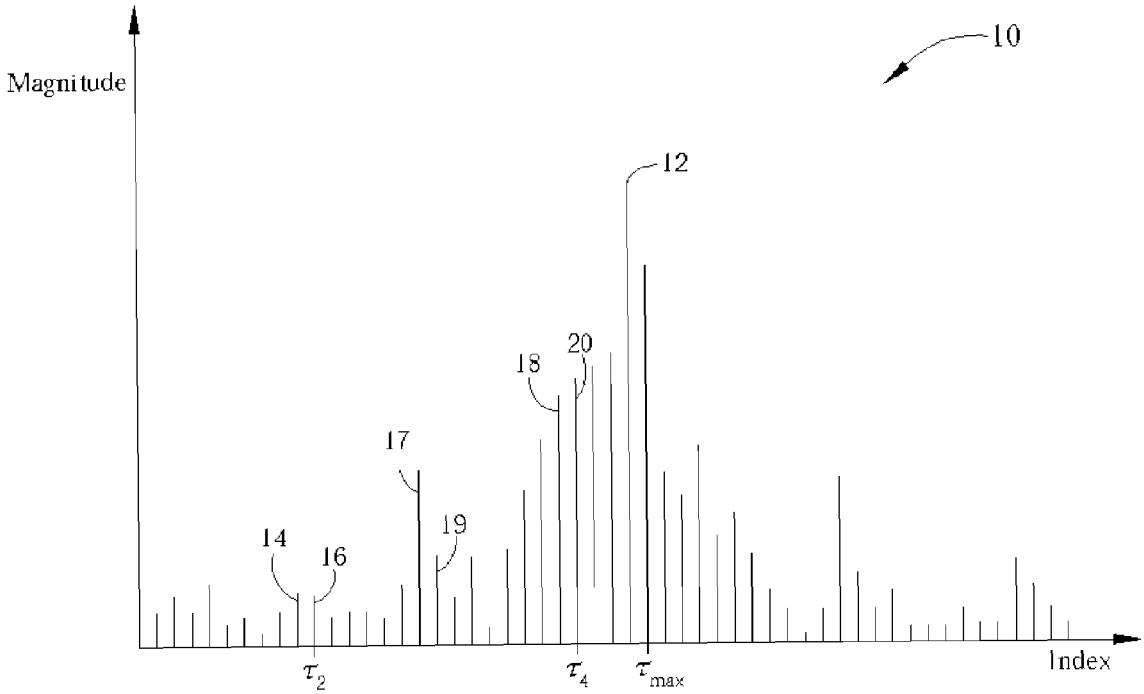
Fig. 1 Prior art
FIG. 1 is an autocorrelogram for TDHS according to the prior art.
Figure 2:
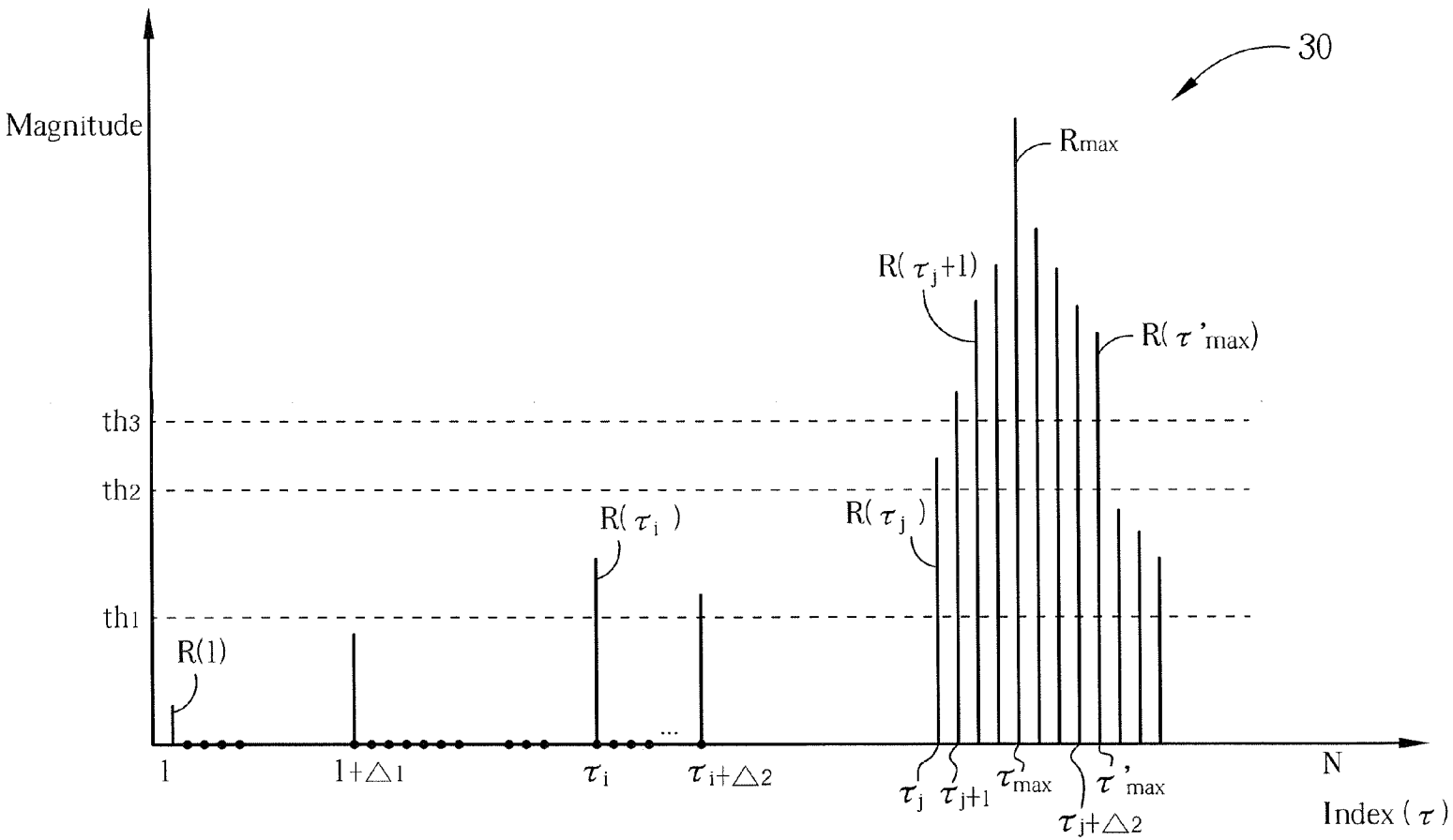
FIG. 2 is an autocorrelogram corresponding to a method according to the present invention.
Figure 3:
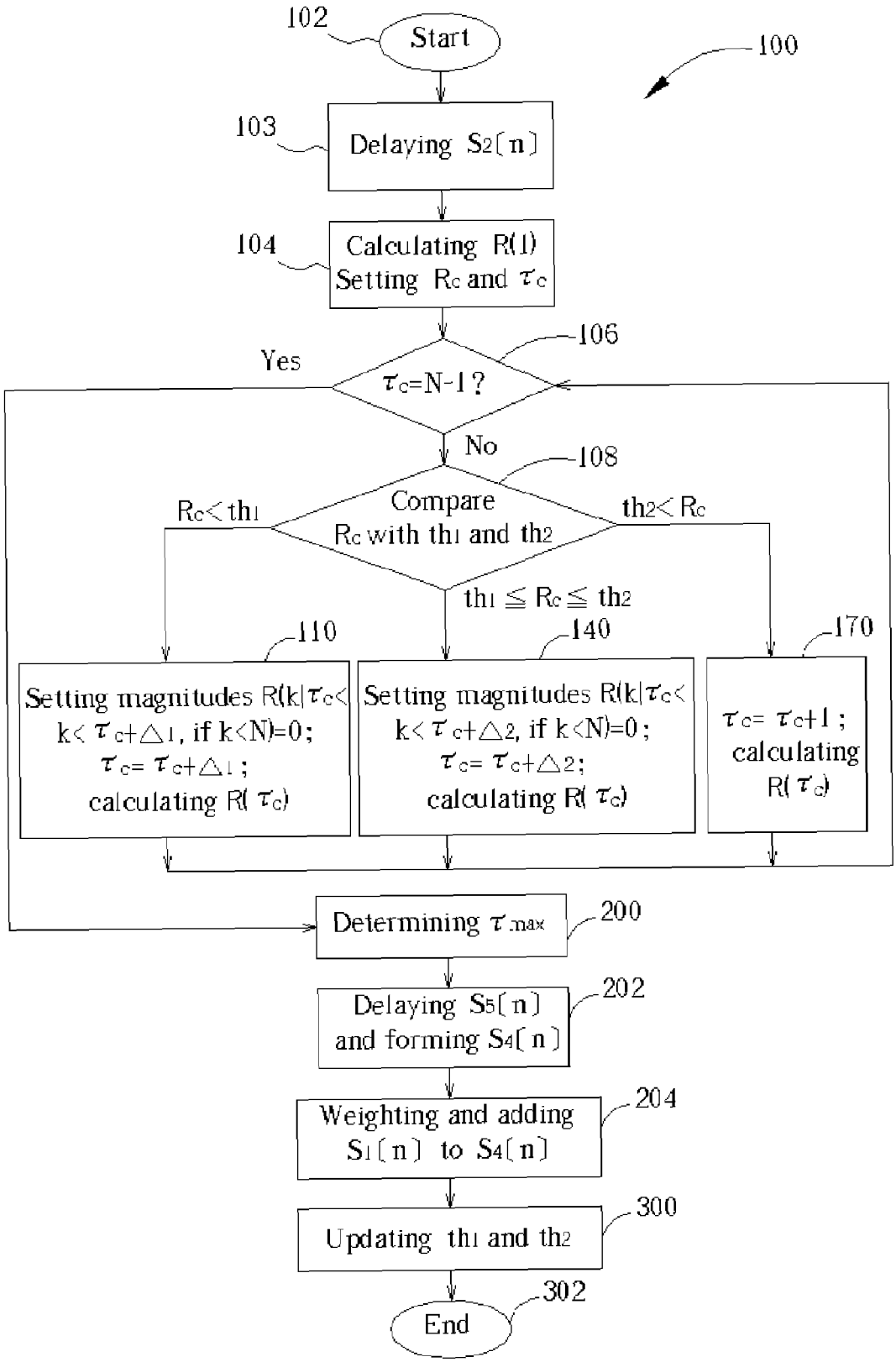
FIG. 3 is a flow chart demonstrating a method according to the present invention.

Please refer to FIG. 2 and FIG. 3. FIG. 2 is an autocorrelogram 30 corresponding to the method 100 according to the present invention. FIG. 3 is a flow chart demonstrating the method 100 according to the present invention. The method 100 comprises following steps:

Step 102: Start; (An $S_3[n]$ signal is to be synthesized from an $S_1[n]$ signal and an $S_2[n]$ signal. For simplicity, the $S_1[n]$ signal and $S_2[n]$ signals are both defined to contain N signals. Of course, the numbers of signals the $S_1[n]$ signal and $S_2[n]$ signal contain can be different.)

Step 103: Delaying the $S_2[n]$ signal by a predetermined number $\Delta$ and forming an $S_5[n]$ signal; (In order to prevent run-in from occurring in a process a pickup of an A/V player reads the $S_3[n]$ signal, the method 100 delays the $S_2[n]$ signal by the predetermined number $\Delta$ and then determines the maximum index $$\tau_{max}$$

crucial for the process to synthesize the $S_3[n]$ signal from the $S_1[n]$ signal and the $S_2[n]$ signal. In the preferred embodiment, the predetermined number $\Delta$ is equal to [N/3].)

Step 104: Calculating an initial magnitude R(1) corresponding to an initial index $$\tau_1(\tau=1)$$

corresponding to the $S_1[n]$ signal and the $S_5[n]$ signal, setting a determinant magnitude $R_c$ to be the initial magnitude R(1), and setting a determinant index $$\tau_c$$

corresponding to the determinant magnitude $R_c$ to be the initial index $$\tau_1$$

; (The initial magnitude R(1) is equal to $$\sum_{n=0}^{N-1} S_1[n] * S_2[n+1]$$

.)

Step 106: If $$(\tau_c = N-1)$$

, then go to step 200, else go to step 108; ( $\tau_c$ equal to N−1, indicates the determinant magnitude $R_c$, is the last magnitude in the autocorrelogram 30. The autocorrelogram 30 is completely established.)

Step 108: Comparing the determinant magnitude $R_c$ with either the first threshold $th_1$ or second threshold $th_2$. If the determinant magnitude $R_c$ is smaller than the first threshold $th_1$ (as the R(1) shown in FIG. 2), then go to step 110; If the determinant magnitude $R_c$ falls on a region between the first threshold $th_1$ and the second threshold $th_2$, then go to step 140; If the determinant magnitude $R_c$ is larger than the second threshold $th_2$, then go to step 170; (If the determinant magnitude $R_c$ is larger than the second threshold $th_2$, indicating the determinant index $\tau_c$ corresponding to the determinant magnitude $R_c$ is located on a region nearby the maximum index $\tau_{max}$ , then the method 100 calculates magnitudes corresponding to indexes right after the determinant index $\tau_c$ (as a magnitude R( $R(\tau_j)$ corresponding to an index $\tau_j$ shown in FIG. 2), or the method 100 neglects the calculation of magnitudes corresponding to indexes following the determinant index $\tau_c$ and calculates magnitudes corresponding to indexes lagging the determinant index $\tau_c$ by the first predetermined number$\Delta_1$ or second predetermined number$\Delta_2$ directly to save the time for a DSP chip to calculate magnitudes in the autocorrelogram 30. Please note that, in order to find out the maximum index $\tau_{max}$ corresponding to the maximum magnitude $R_{max}$ exactly, the first threshold $th_1$ and second threshold $th_2$ can not be defined to have too large values in the beginning to calculate the maximum index $\tau_{max}$ according to the method 100. For example, if the second threshold $th_2$ is set to be a third threshold $th_3$ initially, after calculating the $R(\tau_j)$ , the method 100, according to the decision performed in the step 108, calculates a magnitude $R(\tau_j+\Delta_2)$ instead of calculating a magnitude $R(\tau_j+1)$ and in the end does not calculate the exact magnitude $R(\tau_{max})$ , but obtains a magnitude $R(\tau'_{max})$ instead, a wrong index $\tau'_{max}$ corresponding to the magnitude $R(\tau'_{max})$ is therefore used to synthesize the $S_3[n]$ signal from the $S_{1[n]}$ *and* $S_5[n]$ signals.)

Step 110: Setting magnitudes $R(k|\tau_c<k<\tau_c+\Delta_1, \text{ if } k<N)$ to be zero and the determinant index $\tau_c$ to be( $\tau_c$ +Δ1) and calculating the determinant magnitude $R(\tau_c)$ corresponding to the determinant index $\tau_c$ of the $S_1[n]$ and $S_5[n]$ signals; go to step 106; (The determinant magnitude $R(\tau_c)$ is equal to $$\sum_{n=0}^{N-1} S_1[n] * S_2[n+\tau_C].$$

)

Step 140: Setting magnitudes $R(k|\tau_c<k<\tau_c+\Delta_2, \text{ if } k<N)$ to be zero and the determinant index $\tau_c$ to be( $\tau_c$ +Δ2) and calculating the determinant magnitude $R(\tau_c)$ corresponding to the determinant index $\tau_c$ of the $S_1[n]$ and $S_5[n]$ signals; go to step 106;

Step 170: Setting the determinant index $\tau_c$ to be $(\tau_c+1)$ and calculating the determinant magnitude $R(\tau_c)$ corresponding to the determinant index $\tau_c$ of the $S_1[n]$ and $S_5[n]$ signals; go to step 106;

Step 200: Determining the maximum index $\tau_{max}$ corresponding to the maximum magnitude $R_{max}$ in the autocorrelogram 30;

Step 202: Delaying the $S_5[n]$ signal by the maximum index $\tau_{max}$ and forming an $S_4[n]$ signal;

Step 204: Weighing the $S_1[n]$ signal and adding to the $S_4[n]$ signal and forming the $S_3[n]$ signal; (The $S_3[n]$ signal=$S_1[n]$ signal, where 0<=n<([N/3]+

$\tau_{max}$

); =(N−n)/(N−([N/3]+

$\tau_{max}$

))*$S_1$[n]+(n−([N/3]+$_{max}$))/(N−([N/3]+

$\tau_{max}$

))*$S_4$[n−([N/3]+

$\tau_{max}$

)], where ([N/3]+

$\tau_{max}$

)<=n<N; =$S_4$[n−([N/3]+

$\tau_{max}$

)], where N<=n<=(N+[N/3]+

$\tau_{max}$

))

Step 300: Updating the first threshold $th_1$ and second threshold $th_2$ based on the maximum magnitude $R_{max}$; and (Since the $S_1[n]$ and $S_2[n]$ signals are both derived from an S[n] derived from an original signal $S_{org}$ (an audio or video signal), any sampling signals in the S[n] following the $S_1[n]$ and $S_2[n]$ signals, such as an $S_6[n]$ signal and an $S_7[n]$ signal, have certain characteristics similar to those of the $S_1[n]$ and $S_2[n]$ signals. Therefore, the maximum magnitude $R_{max}$ calculated in step 200 can be used to be an updating reference to update the first threshold $th_1$ and the second threshold $th_2$ needed for the synthesizing of the $S_6[n]$ and $S_7[n]$ signals, omitting the necessity to set too small and the first threshold $th_1$ and second threshold $th_2$ from calculating the wrong maximum index $\tau'_{max}$ , too small the first threshold $th_1$ and second threshold $th_2$ increasing the burden for the DSP chip to calculate unnecessary magnitudes.)

Step 302: End.

Figure 4:
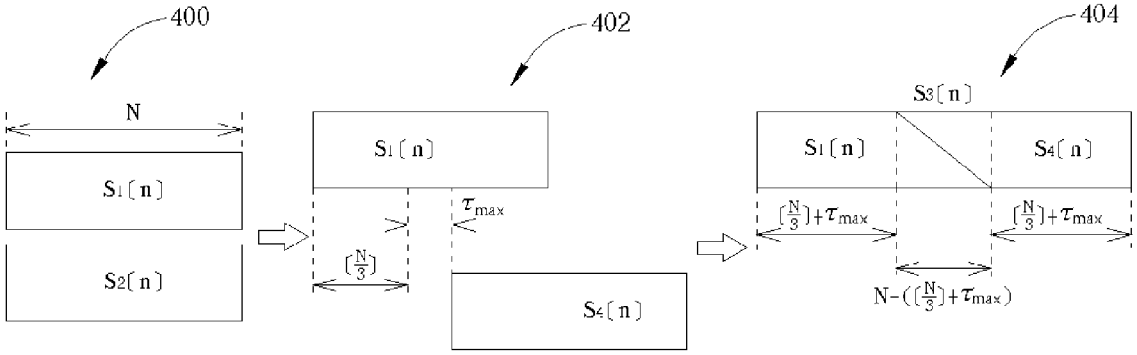
FIG. 4 is a schematic diagram demonstrating how the method synthesizes an $S_3[n]$ signal from an $S_1[n]$ signal and an $S_2[n]$ signal according to the present invention.

Please refer to FIG. 4, which is a schematic diagram demonstrating how the method synthesizes the $S_3[n]$ signal from the $S_1[n]$ and $S_2[n]$ signals according to the present invention. In FIG. 4, a first part 400 shows the $S_1[n]$ and $S_2[n]$ signals in the step 102 of the method 100, a second part 402 shows the maximum index $\tau_{max}$ and the $S_4[n]$ signal calculated from the step 103 to step 202 of the method 100, and a third part 404 shows the $S_3[n]$ signal synthesized from the $S_1[n]$ and $S_4[n]$ signals in the step 204 of the method 100.

In the preferred embodiment of the present invention, the magnitudes $R(k|\tau<k<\tau+\Delta_{1'2}$, if $k<N)$ calculated in the steps 110 and 114 of the method 100 are all set to be zero. However, these magnitudes can be set to be any values, equal or different from each other, as long as these values are all smaller, preferably far smaller, than the maximum magnitude $R_{max}$.

Figure 5:
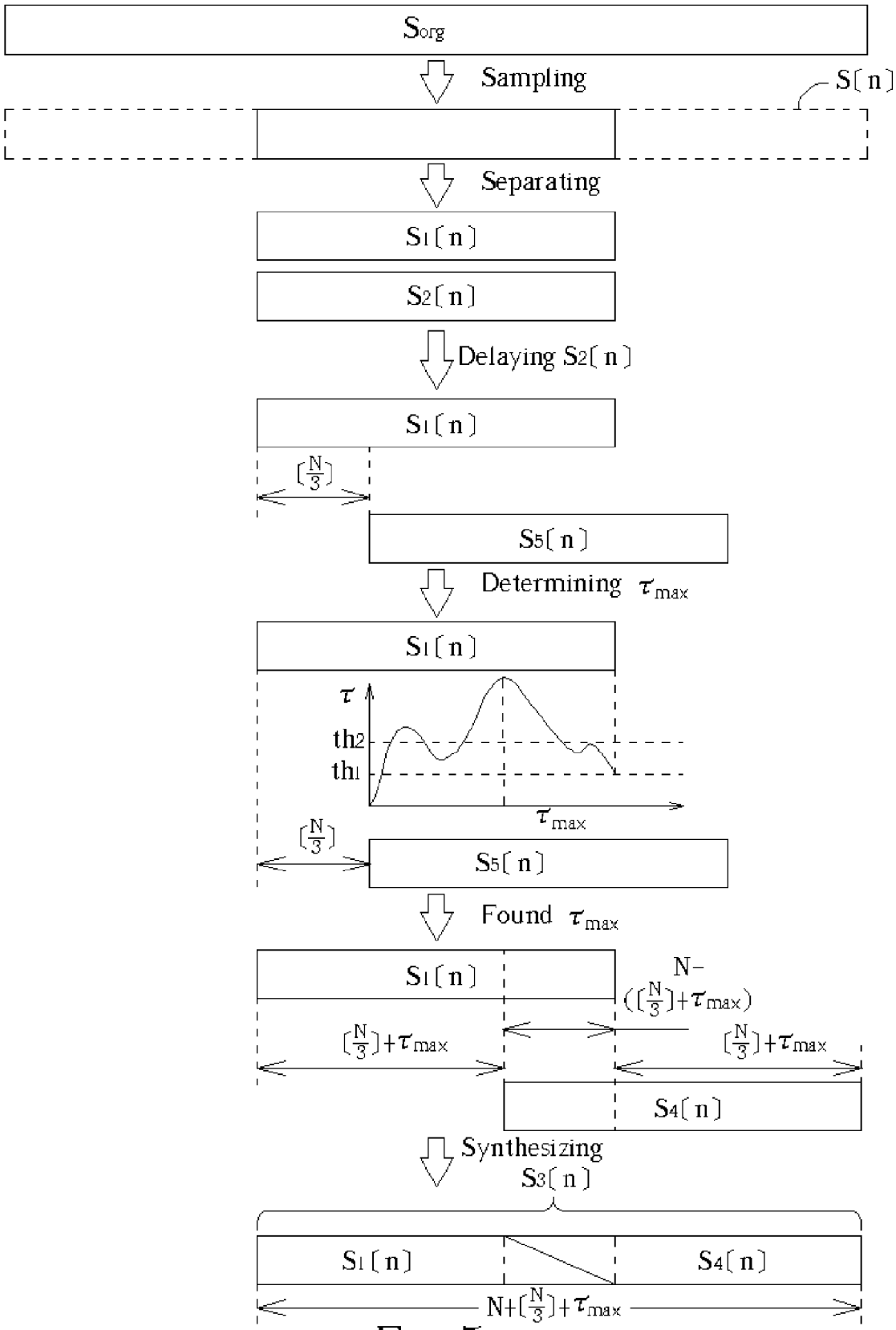
FIG. 5 is a schematic diagram demonstrating how the method elongates an audio signal according to the present invention.
Figure 6:
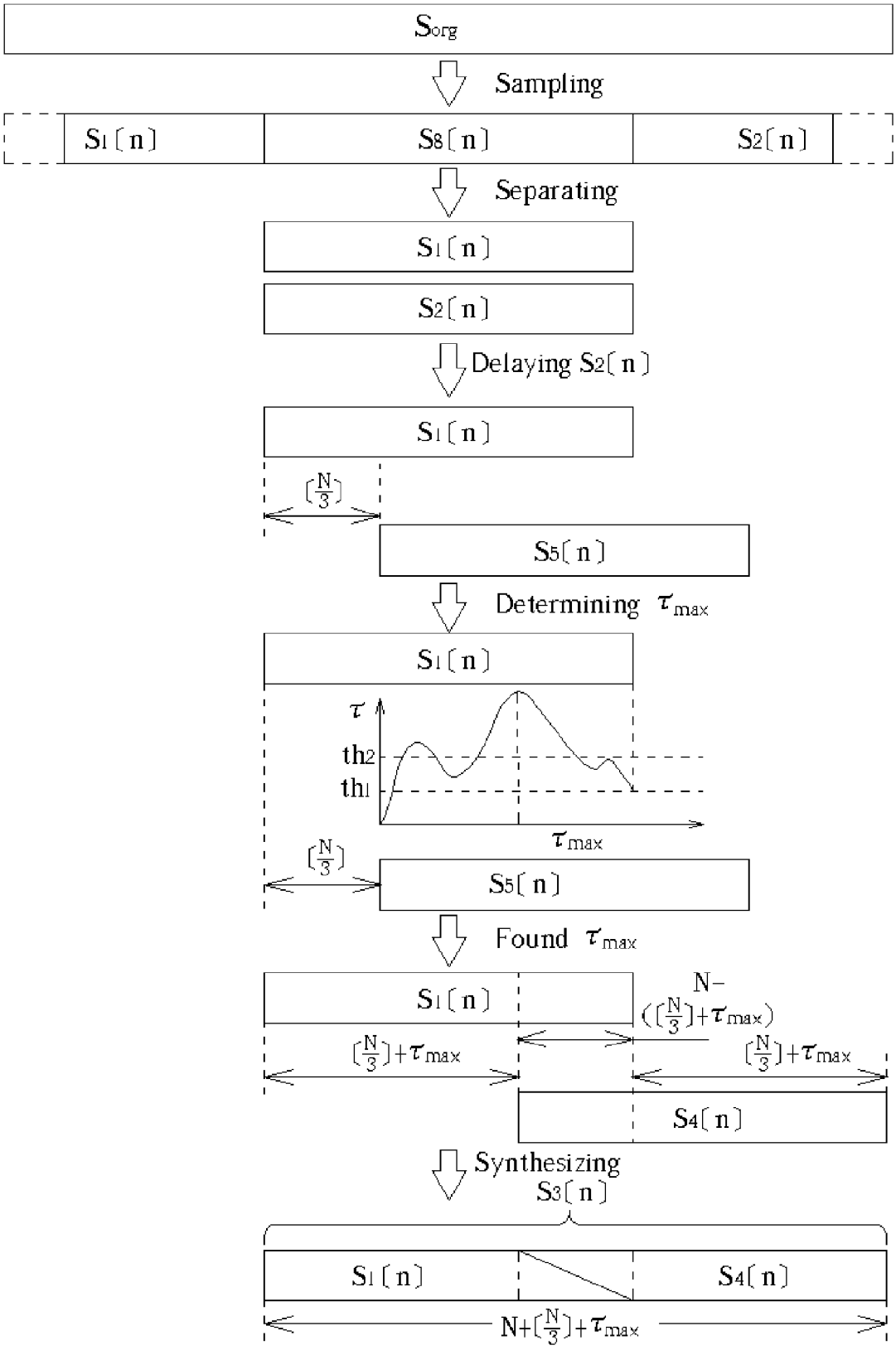
FIG. 6 is a schematic diagram demonstrating how the method shortens an audio signal according to the present invention.

If the $S_1[n]$ signal is the same as the $S_2$ [n] signal and both are derived from the S[n] at an identical region, as shown in FIG. 5, the method 100 in fact elongates the $S_1[n]$. On the contrary, if the $S_1[n]$ signal and the $S_2[n]$ signals are different from each other and are derived from the S[n] at two distinct regions respectively, as shown in FIG. 6, the method 100 in fact combines and shortens the $S_1[n]$, an S [n] (discarded) and the $S_2[n]$ signals into the $S_3[n]$ signal.

In contrast to the prior art, the method of the present invention compares a temporary magnitude ($R_c$) in an autocorrelogram with a threshold ($th_1$ or $th_2$) and calculates magnitudes corresponding to indexes lagging a temporary index corresponding to the temporary magnitude by a predetermined number without calculating all magnitudes in the autocorrelogram, saving time for a DSP chip to calculate the maximum index $\tau_{max}$ and therefore promoting the efficiency of a computer where the DSP chip is installed in accordingly. In the preferred embodiment of the present invention, the first pre-determined number is 24 while the second predetermined number is 6, the first threshold $th_1$ and the second thresholds $th_2$ can be set to be $R_{max}/2$ and $R_{max}/4$ respectively, that is numbers truncating the maximum magnitude $R_{max}$ by one and two bits respectively, and count of the calculation can be reduced to ten percent without impacting quality of the $S_3[n]$ signal.

Following the detailed description of the present invention above, those skilled in the art will readily observe that numerous modifications and alterations of the device may be made while retaining the teachings of the invention. Accordingly, the above disclosure should be construed as limited only by the metes and bounds of the appended claims.

What is claimed is:

1. A multiple step-sized levels adaptive method for time scaling to synthesize an $S_3[n]$ signal from an $S_1[n]$ signal and an $S_2[n]$ signal, the method comprising:

(a) calculating a temporary magnitude of a cross-correlation function of the $S_1[n]$ signal and the $S_2[n]$ signal according to a temporary index;

(b) comparing the temporary magnitude with a threshold value;

(c) if the temporary magnitude is smaller than the threshold value, calculating a first reference magnitude of the cross-correlation function of the $S_1[n]$ signal and the $S_2[n]$ signal according to a first reference index lagging the temporary index by a first determined number, or calculating a second reference magnitude of the cross-correlation function of the $S_1[n]$ signal and the $S_2[n]$ signal according to a second reference index lagging the temporary index by a second number; and (d) synthesizing the $S_3[n]$ signal by weighting the $S_1[n]$ signal and adding the weighted $S_1[n]$ signal to an $S_4[n]$ signal that lags the $S_2[n]$ by a maximum index corresponding to a largest magnitude among all of the magnitudes calculated in step (c), wherein the $S_1[n]$ signal has $N_1$ elements while the $S_2[n]$ signal has $N_2$ elements, and the $S_3[n]$ signal =the $S_1[n]$ signal, where 0<=n<the maximum index;

=$(N_1-n)/(N_1-\text{the maximum index})*S_1[n]+(n-\text{the maximum index})/(N_1-\text{the maximum index})*S_4[n-\text{the maximum index}]$, where the maximum index <=n<$N_1$;

=$S_4[n-\text{the maximum index}]$, where $N_1$<=n<=$N_2$−the maximum index.

2. The method of claim 1 wherein step (c) further comprises:

(e) setting each of the magnitudes corresponding to indexes between the temporary index and the first reference index to zero or setting each of the magnitudes corresponding to indexes between the temporary index and the second reference index to zero.

3. The method of claim 1 further comprising:

(f) updating the threshold value according to the maximum index.

4. The method of claim 1 wherein the $S_1[n]$ signal and the $S_2[n]$ signal are sampled from an $S_1(t)$ signal and an $S_2(t)$ signal respectively.

5. The method of claim 4 wherein the $S_1(t)$ signal and the $S_2(t)$ signal are both derived from an original signal.

6. The method of claim 5 wherein the original signal is an audio signal.

7. The method of claim 5 wherein the original signal is a video signal.

8. The method of claim 5 wherein the $S_1(t)$ signal and the $S_2(t)$ signal are identical.

9. The method of claim 5 wherein the $S_1(t)$ signal and the $S_2(t)$ signal are different from each other.

10. The method of claim 1 wherein the second number is equal to one.

11. The method of claim 1 wherein the first determined number is larger than one.

12. A multiple step-sized levels adaptive method for time scaling to synthesize an $S_3[n]$ signal from an $S_1[n]$ signal and an $S_2[n]$ signal, the method comprising:

(a) delaying the $S_1[n]$ signal by a predetermined number to form an $S_5[n]$ signal;

(b) calculating a temporary magnitude of a cross-correlation function of the $S_1[n]$ signal and $S_5[n]$ signal according to a temporary index;

(c) comparing the temporary magnitude with a threshold value;

(d) if the temporary magnitude is smaller than the threshold value, calculating a first reference magnitude of the cross-correlation function of the $S_1[n]$ signal and the $S_2[n]$ signal according to a first reference index lagging the temporary index by a first determined number, or calculating a second reference magnitude of the cross-correlation function of the $S_1[n]$ signal and the $S_2[n]$ signal according to a second reference index lagging the temporary index by a second number; and (e) synthesizing the $S_3[n]$ signal by weighting the $S_1[n]$ signal and adding the weighted $S_1[n]$ signal to an $S_4[n]$ signal that lags the $S_5[n]$ signal by the predetermined number plus a maximum index corresponding to a largest magnitude among all of the magnitudes calculated in step (d), wherein the $S_1[n]$ signal has $N_1$ elements while the $S_2[n]$ signal has $N_2$ elements, and the $S_3[n]$ signal equals:

=the $S_1[n]$ signal, where 0<=n<(the predetermined number+the maximum index);

=$(N_1-n)/(N_1-(\text{the predetermined number+the maximum index}))*S_1[n]+(n-(\text{the predetermined number+the maximum index}))/(N_1-(\text{the predetermined number+the maximum index}))*S_4[n-(\text{the predetermined number+the maximum index})]$, where (the predetermined number+the maximum index)<=n<$N_1$;

=$S_4[n-(\text{the predetermined number+the maximum index})]$, where $N_1$<=n<=($N_2$+the predetermined number+the maximum index).

13. The method of claim 12 wherein step (d) further comprises:

(f) setting each of the magnitudes corresponding to indexes between the temporary index and the first reference index to zero or setting each of the magnitudes corresponding to indexes between the temporary index and the second reference index to zero.

14. The method of claim 12 further comprising:

(g) updating the threshold value according to the maximum index.

15. The method of claim 12 wherein the second number is equal to one.

16. The method of claim 12 wherein the first determined number is larger than one.

* * * * *